US005947617A

United States Patent [19]

Kondo

[11] Patent Number: 5,947,617

[45] Date of Patent: Sep. 7, 1999

[54] SKEW CORRECTION MECHANISM FOR A ROLL PAPER

[75] Inventor: Shin Kondo, Tokyo, Japan

[73] Assignee: NEC Corporation, Tokyo, Japan

[21] Appl. No.: 08/960,461

[22] Filed: Oct. 29, 1997

[30] Foreign Application Priority Data

Oct. 30, 1996 [JP] Japan ..... 8-287816

[51] Int. Cl.[6] ..... B41J 11/42

[52] U.S. Cl. ..... 400/579; 226/19; 226/20; 226/49

[58] Field of Search ..... 400/579; 226/10, 226/16, 17, 19, 20, 45, 49

[56] References Cited

U.S. PATENT DOCUMENTS

| | | | |
|---|---|---|---|
| 4,839,674 | 6/1989 | Hanagata et al. | 400/579 |
| 5,138,341 | 8/1992 | Kobayashi | 400/579 |
| 5,189,957 | 3/1993 | Kobler et al. | 101/409 |
| 5,216,444 | 6/1993 | Noguchi et al. | 400/579 |

FOREIGN PATENT DOCUMENTS

| | | | |
|---|---|---|---|
| 58-154244 | 10/1983 | Japan . | |
| 0227364 | 9/1988 | Japan | 400/579 |
| 363278880 | 11/1988 | Japan | 400/579 |
| 2-75553 | 3/1990 | Japan . | |
| 403227274 | 10/1991 | Japan | 400/579 |
| 4-169259 | 6/1992 | Japan . | |
| 404334470 | 11/1992 | Japan | 400/579 |
| 6-263301 | 9/1994 | Japan . | |
| 79858 | 2/1995 | Japan . | |

OTHER PUBLICATIONS

"Skewed Drives" Arsenault et al, IBM Technical Disclosure Bulletin, vol. 23, No. 5, Oct. 1980 pp. 1817–1818.

"Pivoting Registration Roll for Bidirectional Registering Sheet Feed" Arldt et al, IBM Technical Disclosure Bulletin, vol. 26, No. 7A p. 3133, Dec. 1983.

"Self Adjusting Document–Feed–Skew–Correcting Device", IBM Technical Disclosure Bulletin, vol. 35 No. 1B pp. 93–95, Jun. 1992.

*Primary Examiner*—Eugene Eickholt

*Attorney, Agent, or Firm*—Sughrue,Mion, Zinn, Macpeak & Seas., PLLC

[57] ABSTRACT

A printer comprises a skew correction mechanism for a roll paper between a roll paper loading section and a recording section. The skew correction mechanism has a pair of first roller and second roller each having a guide surface for the roll paper, arranged in the transverse direction of the roll paper and eccentrically mounted on respective shafts. A skew of the roll paper is detected by a skew sensor, and the first and second rollers is rotated by a predetermined angle in the opposite directions to obtain different path lengths for the roll paper between both the guide surfaces of the rollers, thereby correcting the skew feed of the roll paper.

10 Claims, 3 Drawing Sheets

SKEW CORRECTION MECHANISM FOR A ROLL PAPER

BACKGROUND OF THE INVENTION (a) Field of the Invention

The present invention relates to a skew correction mechanism and, more particularly, to a technique for correcting a skew movement of a roll paper in a printer etc. The present invention also relates to a printer having such a skew correction mechanism.

(b) Description of the Related Art

A printer having a conventional skew correction mechanism for correcting a skew feed of a roll paper, or continuous paper, is described in Patent Publication No. JP-A-2(1990)-75553, for example. The printer described therein has a driving roller and a driven roller supported to oppose each other for skew correction. The skew amount of the roll paper is calculated based on a skew signal from a skew sensor mounted on the printer body to control the distance between the rotational shafts of both the rollers. As a result, the clamping force by which the roll paper is held between the rollers is changed along the transverse direction of the roll paper, thereby correcting the skew of the roll paper.

In the skew correction mechanism as described above, the change of the distance between the rotational shafts of both the rollers sometimes involves jamming of the roll paper by an excess clamping force for the roll paper, and also prevents accurate feed rate of the roll paper.

Some small-sized printers using a roll paper have a guide along the path route of the roll paper. The guide generally comprises a guide shaft extending in the transverse direction for guiding the roll paper thereon while changing the direction of the feed of the roll paper to stabilize the feed. In this type of the small-sized printer, the skew amount of the roll paper is generally large because the rolling force of the roll paper during fabrication thereof is not always constant along the transverse direction of the roll paper, because the radius and alignment of the guide shaft is not always constant along the axis thereof, and because a small amount of misalignment is generally involved when the roll paper is loaded on the printer. Accordingly, if the small-sized printer is provided with the skew correction mechanism proposed in the Patent Publication as mentioned above, the skew correction mechanism is not always effective to correct the skew feed of the roll paper.

SUMMARY OF THE INVENTION

It is therefore an object of the present invention to provide a skew correction mechanism for effectively correcting the skew feed of the roll paper in a printer etc.

It is another object of the present invention to provide a printer, especially a small-sized printer, having such a correction mechanism as mentioned above.

The present invention provides a skew correction mechanism for a roll paper comprising a pair of rollers arranged in a transverse direction of the roll paper and each having a guide surface for guiding a corresponding portion of the roll paper, at least one skew sensor for detecting a skew of the roll paper to generate a skew signal, a drive section for moving at least one of the pair of rollers to obtain different path lengths for the roll paper between both the guide surfaces of the pair of rollers.

The present invention also provides a printer comprising a roll paper loading section for loading a roll paper, a recording section for recording information onto the roll paper, and a guide section, disposed between the roll paper loading section and the recording section for guiding the roll paper, the guide section having a pair of rollers arranged in a transverse direction of the roll paper and each having a guide surface for guiding a corresponding portion of the roll paper, at least one skew sensor for detecting a skew of the roll paper to generate a skew signal, a drive section for moving at least one of the pair of rollers to obtain different path lengths for the roll paper between both the guide surfaces of the pair of rollers.

In accordance with the skew correction mechanism or printer of the present invention, the guide surface of at least one of the pair of rollers is controlled by the movement of the roller to thereby obtain different path lengths of the roll paper in the transverse direction based on the signal fed by the skew sensor. As a result, the roll paper is smoothly moved in the transverse direction while running in the feed direction so that the skew feed of the roll paper is corrected during the feed.

PREFERRED EMBODIMENTS OF THE INVENTION

Figure 1:
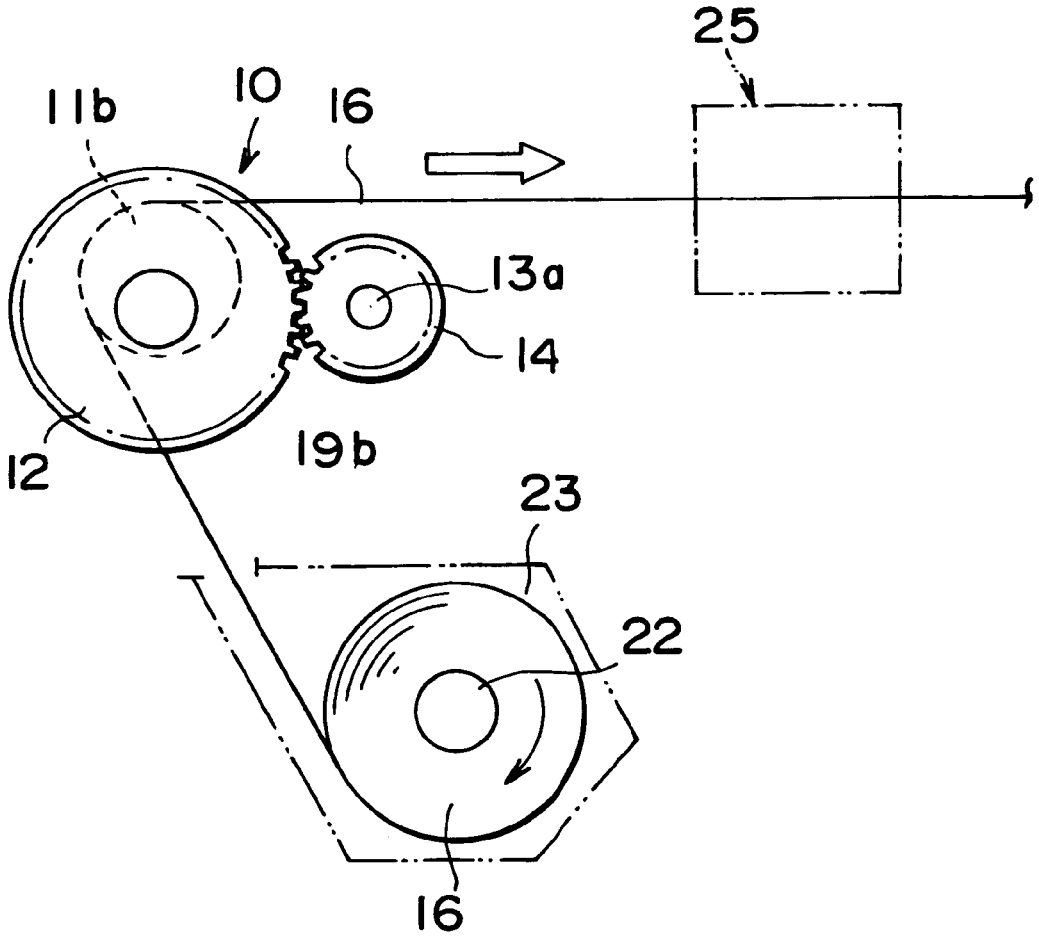
FIG. 1 is side view of a printer having a skew correction mechanism according to an embodiment of the present invention.

Now, the present invention is more specifically described with reference to the drawings. Referring to FIG. 1, a printer having a skew correction mechanism according to an embodiment of the present invention comprises a roll paper loading section 23 for mounting a roll paper 16 rolled around a core 22, a recording section 25 for printing information onto the roll paper 16 fed from the roll paper loading section 23, and a guide section 10 disposed between the roll paper loading section 23 and the recording section 25 for controlling the path length of the roll paper 16.

Figure 2:
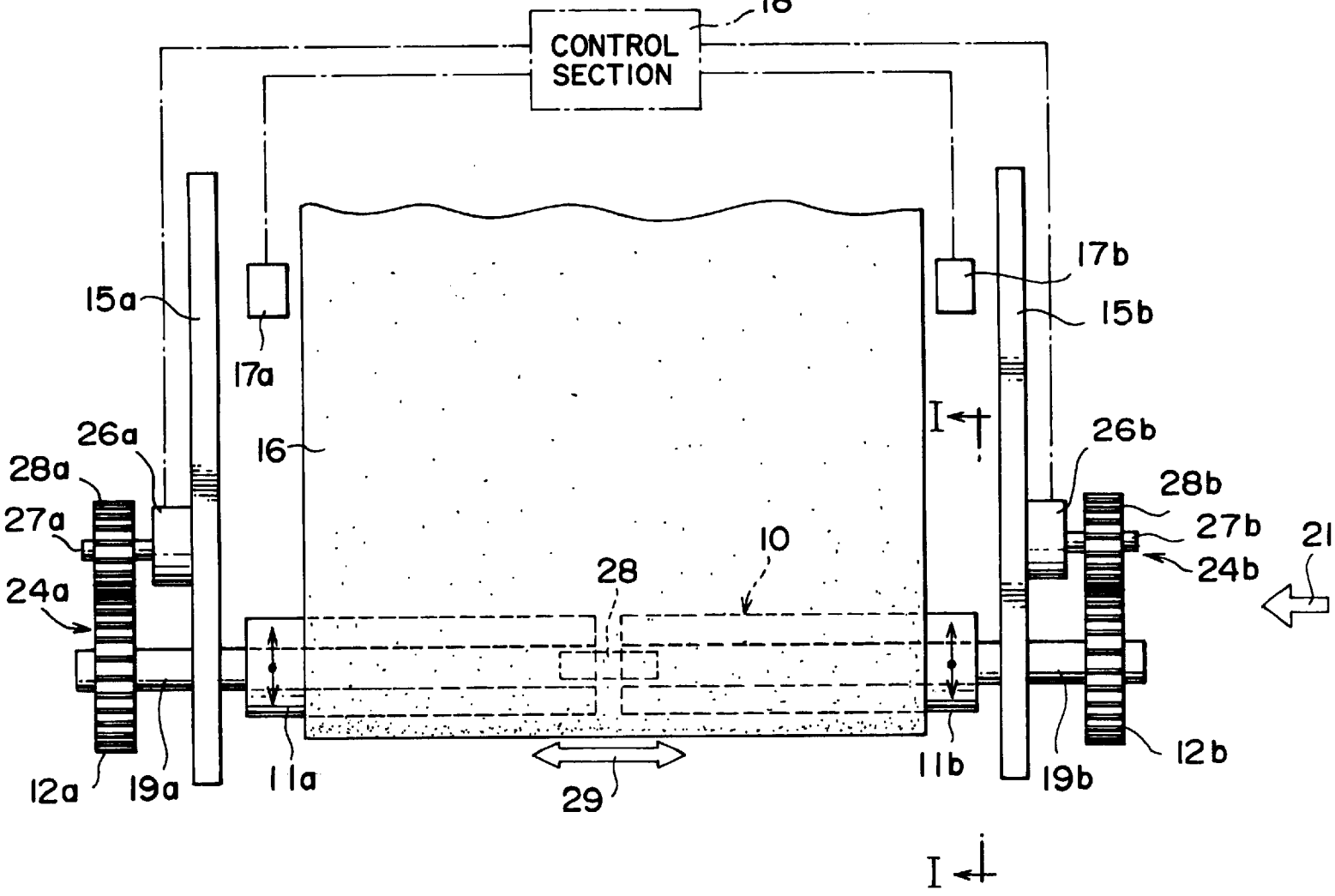
FIG. 2 is a top plan view of the skew correction mechanism for a roll paper shown in FIG. 1, which is taken along line I—I in FIG. 2.

Referring to FIG. 2, the guide section 10 comprises a first roller 11*a* and a second roller 11*b* arranged along the axis of the guide section 10 and parallel to the transverse direction of the roll paper. Each of the first and second roller 11*a* and 11*b* is eccentrically mounted in unison by a corresponding rotational shaft 19*a* or 19*b*. Both the rotational shafts 19*a* and 19*b* are coupled together for rotation by a coupling shaft 20 at the proximal ends thereof, and respectively supported by side plates 15*a* and 15*b* of the guide section 10 at the distal ends thereof. In this configuration, the rotational shafts 19*a* and 19*b* are aligned with each other to form a straight line at the central axes thereof. The first and second rollers 11*a* and 11*b* are made of a metallic material for smoothly guiding the roll paper 16.

Each of the first and the second rotational shafts 19*a* and 19*b* protrudes from the corresponding side plate 15*a* or 15*b* at the distal end thereof, which is provided with a co-axial driven gear 12*a* or 12*b*. The driven gear 12*a* or 12*b* is driven by a corresponding driving gear 28*a* or 28*b*, which is in turn driven by a stepping motor 26*a* or 26*b* mounted on the corresponding side plate 15*a* or 15*b*. The combination of the driving gear 28*a*, driven gear 12*a* and the step motor 26*a* constitutes a first driving mechanism 24*a* for rotating the first roller 11*a* via the rotational shaft 19*a,* whereas the combination of the driving gear 28*b,* driven gear 12*b* and the step motor 26*b* constitutes a second driving mechanism 24*b* for rotating the second roller 11*b* via the rotational shaft 19*b.*

Skew sensors 17*a* and 17*b* are disposed in the vicinities of the respective transverse edges of the path route of the roll paper 16 for providing a skew signal to a control section 18. Each of the skew sensors 17*a* and 17*b* comprises a light source for periodically emitting light and a photodetector for receiving the emitted light. The skew sensor 17*a* provides a skew signal to the control section 18 each time the optical path between the light source and the optical sensor is intercepted by the edge portion of the roll paper 16 in one operational cycle of the skew sensors 17*a* and 17*b.*

The control section 18 controls first and second driving mechanism 24*a* or 24*b* separately by rotating the step motors 26*a* and 26*b* in the opposite directions by one step each time the skew sensor 17*a* or 17*b* detects a skew of the roll paper 16.

In operation of the printer as described above, the skew sensors 17*a* and 17*b* monitor the skew feed of the roll paper 16 periodically while the roll paper 16 passes the guide section 10 towawrd the recording section 25. When one of the skew sensors 17*a* and 17*b,* for example the skew sensor 17*a,* detects a skew of the roll paper 16, as shown in FIG. 2, by detecting the intercept of the optical path thereof, the skew sensor generates a skew signal. The control section 18, after receiving the skew signal, rotates the step motor 26*a* by one step in the counter-clockwise direction as viewed in FIG. 1, and rotates the step motor 26*b* by one step in the clockwise direction as viewed in FIG. 1.

Figure 3:
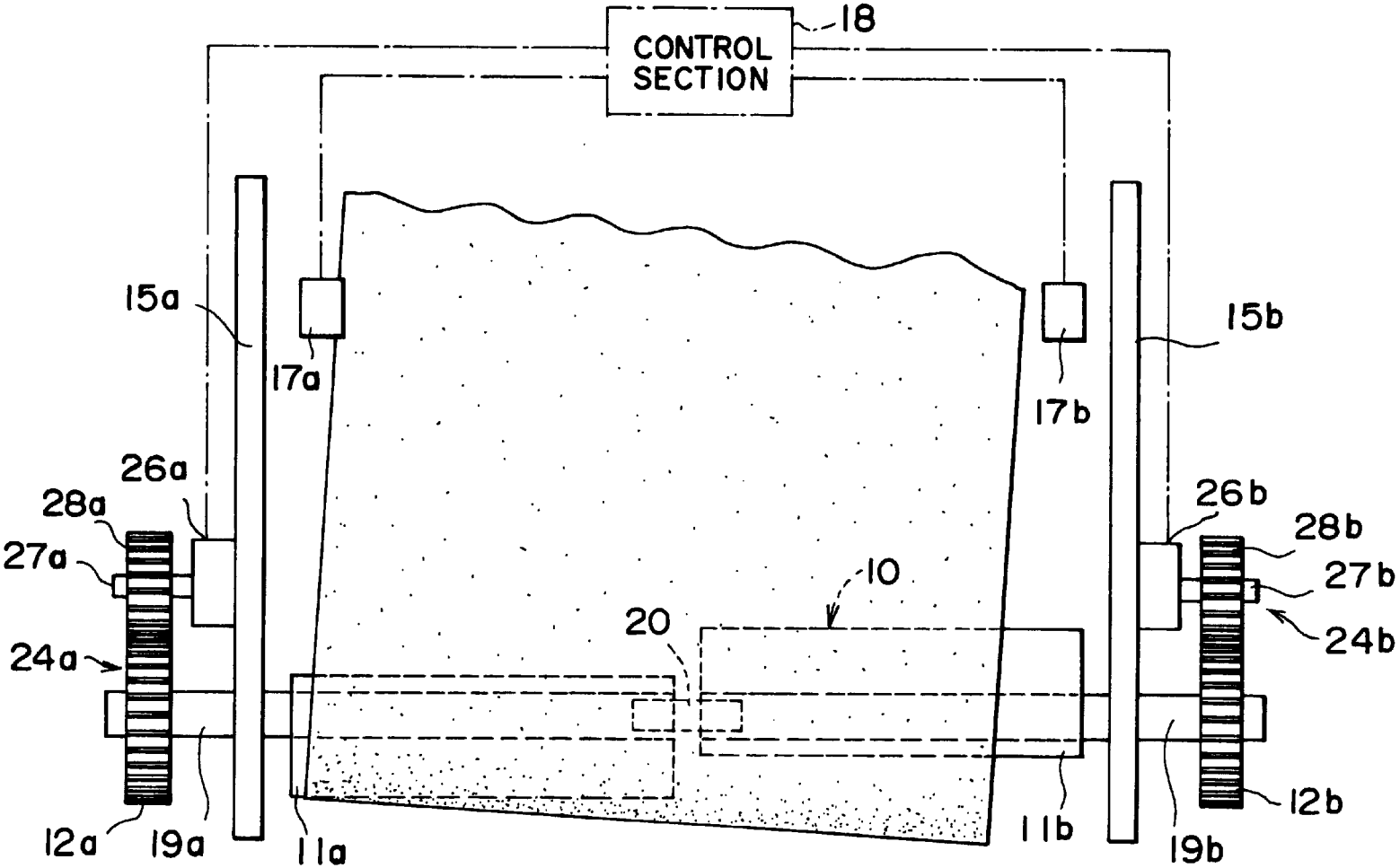
FIG. 3 is another top plan view of the skew correction mechanism of FIG. 2 after the first and second rollers are moved to shift the feed of the roll paper.

As a result, the first roller 11*a* and the second roller 11*b* are rotated in the clockwise direction and counter-clockwise direction, respectively, by a predetermined angle, to thereby move the first and second rollers 11*a* and 11*b* in the opposite directions which are parallel to the longitudinal direction of the roll paper 16, thereby obtaining different path lengths for the roll paper 16 between both the halves of the roll paper. The different path lengths of the roll paper 16 allow the roll paper 16 to shift itself in the right as viewed in FIG. 3, thereby smoothly correcting the feed direction of the roll paper 16.

If the skew is not corrected by the one-step rotations of both the step motors 26*a* and 26*b,* the skew sensor 17*a* further detects the skew of the roll paper 16 by detecting an intercept of the optical path thereof during the next operational cycle, thereby further rotating the step motors 26*a* and 26*b* by an additional one-step. The rotation of the step motors 26*a* and 26*b* continue until the skew feed of the roll paper 16 is corrected.

If the skew of the roll paper 16 is detected by the skew sensor 17*b* by detecting an intercept of the optical path thereof, the step motors 26*a* and 26*b* rotate in the directions reverse to those as describe above, thereby correcting the skew feed of the roll paper 16 in the reverse directions.

In the above embodiment, both the first and second rollers 11*a* and 11*b* mounted eccentrically on the respective rotational shafts are rotated in the opposite directions. However, a modified configuration may be employed wherein only one of the rollers is eccentrically mounted on the corresponding shaft and is rotated based on the skew signal in either the clockwise or counter-clockwise direction, whereas the other of the rollers is concentrically mounted on the corresponding shaft, thereby obtain different path lengths of the roll paper in the transverse direction thereof. In this case, a common rotational shaft may be provided instead for both the rollers. Further, more than two of the rollers may be arranged along the axis of the guide section, if desired, and may be separately controlled by the control section.

Since the above embodiments are described only for examples, the present invention is not limited to the above embodiments and various modifications or alterations can be easily made therefrom by those skilled in the art without departing from the scope of the present invention.

What is claimed is:

1. A skew correction mechanism for a roll of paper comprising a pair of rollers arranged with their respective axes parallel to a direction transverse to a feed direction of the roll of paper and each having a respective guide surface for guiding a corresponding portion of the roll of paper, at least one skew sensor for detecting a skew of the roll of paper to generate a skew signal, and a drive section for shifting the guide surface of one of said two guide rollers with respect to the guide surface of said other roller in the feed direction of the roll of paper so as to define different path lengths, thereby correcting the detected skew of the roll of paper.

2. The skew correction mechanism as defined in claim 1, wherein said at least one skew sensor include a pair of skew sensors each disposed in the vicinity of a corresponding one of path routes of both edges of the roll of paper.

3. The skew correction mechanism as defined in claim 1, wherein each of said pair of rollers is eccentrically mounted on a corresponding shaft.

4. The skew correction mechanism as defined in claim 1, wherein one of said pair of rollers is eccentrically mounted on a rotational shaft and the other of said pair of rollers is concentrically mounted on said rotational shaft.

5. A printer comprising:

a roll of paper loading section for loading a roll of paper, a recording section for recording information onto the roll of paper, a guide section, disposed between said roll of paper loading section and said recording section for guiding the roll of paper, said guide section having a pair of rollers arranged with their respective axes parallel to a direction transverse to a feed direction of the roll of paper and each having a respective guide surface for guiding a corresponding portion of the roll of paper, at least one skew sensor for detecting a skew of the roll of paper to generate a skew signal, a drive section for shifting the guide surface of one of said two guide rollers with respect to the guide surface of said other roller in the feed direction of the roll of paper so as to define different path lengths, thereby correcting the detected skew of the roll of paper.

6. The printer as defined in claim 5, wherein said at least one skew sensor include a pair of skew sensors each disposed in the vicinity of a corresponding one of path routes of both edges of the roll of paper.

7. The printer as defined in claim 5, wherein each of said pair of rollers is eccentrically mounted on a corresponding shaft.

8. The printer as defined in claim 5, wherein one of said pair of rollers is eccentrically mounted on a rotational shaft and the other of said pair of rollers is concentrically mounted on said rotational shaft.

9. A skew correction mechanism for a roll of paper comprising a pair of rollers arranged with their respective axes parallel to a direction transverse to a feed direction of the roll of paper and each having a respective guide surface for guiding a corresponding portion of the roll of paper, at least one skew sensor for detecting a skew of the roll of paper to generate a skew signal, and a drive section for moving at least one of the pair of rollers to obtain different path lengths for the roll of paper between both the guide surfaces of said pair of rollers; and wherein one of said pair of rollers is eccentrically mounted on a rotational shaft and the other of said pair of rollers is concentrically mounted on said rotational shaft.

10. A printer comprising a roll of paper loading section for loading a roll of paper, a recording section for recording information onto the roll of paper, a guide section, disposed between said roll of paper loading section and said recording section for guiding the roll of paper, said guide section having a pair of rollers arranged with their respective axes parallel to a direction transverse to a feed direction of the roll of paper and each having a respective guide surface for guiding a corresponding portion of the roll of paper, at least one skew sensor for detecting a skew of the roll of paper to generate a skew signal, a drive section for moving at least one of said pair of rollers to obtain different path lengths for the roll of paper between both the guide surfaces of said pair of rollers; and wherein one of said pair of rollers is eccentrically mounted on a rotational shaft and the other of said pair of rollers is concentrically mounted on said rotational shaft.

* * * * *